US011000162B2

(12) United States Patent
Saas et al.

(10) Patent No.: US 11,000,162 B2
(45) Date of Patent: May 11, 2021

(54) MULTI-PLY FIBROUS PRODUCT COMPRISING A LAMINATING ADHESIVE WITH A DERMATOLOGICALLY ACCEPTABLE ACID

(71) Applicant: ESSITY HYGIENE AND HEALTH AKTIEBOLAG, Gothenburg (SE)

(72) Inventors: Pascale Saas, Kirchheim (DE); Emilie Pleyber, Selestat (FR); Daniel Hagberg, Gothenburg (SE); Alain Bohn, Kunheim (FR); Frédéric Roesch, Colmar (FR); Yves Enggasser, Biesheim (FR); Clive Smith, Brussels (BE)

(73) Assignee: Essity Hygiene and Health Aktiebolag, Gothenburg (SE)

( * ) Notice: Subject to any disclaimer, the term of this patent is extended or adjusted under 35 U.S.C. 154(b) by 162 days.

(21) Appl. No.: 16/071,595

(22) PCT Filed: Jan. 27, 2016

(86) PCT No.: PCT/EP2016/051716
§ 371 (c)(1),
(2) Date: Jul. 20, 2018

(87) PCT Pub. No.: WO2017/129240
PCT Pub. Date: Aug. 3, 2017

(65) Prior Publication Data

US 2019/0021553 A1 Jan. 24, 2019

(51) Int. Cl.

| | |
|---|---|
| ***A47K 10/16*** | (2006.01) |
| ***D04H 1/593*** | (2012.01) |
| ***D21H 27/00*** | (2006.01) |
| ***D21H 27/32*** | (2006.01) |
| ***D21H 27/40*** | (2006.01) |
| ***D21H 27/30*** | (2006.01) |
| ***B31F 1/07*** | (2006.01) |

(52) U.S. Cl.
CPC ..... *A47K 10/16* (2013.01); *B31F 1/07* (2013.01); *D04H 1/593* (2013.01); *D21H 27/002* (2013.01); *D21H 27/30* (2013.01); *D21H 27/32* (2013.01); *D21H 27/40* (2013.01); *B31F 2201/0733* (2013.01); *B31F 2201/0738* (2013.01); *B31F 2201/0764* (2013.01); *B31F 2201/0787* (2013.01)

(58) Field of Classification Search
CPC ..... D21H 27/002; D21H 27/30; D21H 27/02; D21H 27/32; D21H 17/14; B32B 5/26; B32B 2555/00; B32B 2250/20; B32B 2250/04; B32B 2255/12; B32B 2317/12; B32B 5/022; B32B 2262/062; B32B 2262/067; B32B 29/00; B32B 5/024; B31F 1/07; B31F 2201/0738; B31F 2201/0787; B31F 2201/0733; B31F 2201/0756; B31F 2201/0764; B31F 1/12; B31F 2201/0761; C09J 129/04; Y10T 156/1023; Y10T 156/1798; Y10T 428/1303; A47K 10/16; D04H 1/593; D21F 11/006; Y10S 514/844
See application file for complete search history.

(56) References Cited

U.S. PATENT DOCUMENTS

| | | | | |
|---|---|---|---|---|
| 3,135,648 A * | 6/1964 | Hawkins | C09J 129/04 428/511 |
| 3,794,034 A | 2/1974 | Jones, Sr. | |
| 4,738,847 A * | 4/1988 | Rothe | D21H 21/36 162/158 |
| 4,764,418 A * | 8/1988 | Kuenn | A01N 25/34 428/913 |

(Continued)

FOREIGN PATENT DOCUMENTS

| | | |
|---|---|---|
| CN | 1468115 A | 1/2004 |
| EP | 0991436 A1 | 4/2000 |

(Continued)

OTHER PUBLICATIONS

Colombian Office Action Oficio N° 1054 dated Jan. 22, 2020 issued in Colombian patent application No. NC2018/0007637 (12 pages) and its partial English-language translation therof (7 pages).
Decision to Grant, along with its English-language tranlation, that issued in Russian patent application No. 2018130595/05 (049751) dated Aug. 9, 2019 attached.
English-language translation of Official Action and Search Report that issued in Russian patent application No. 2018130595/05 (049751) dated Apr. 24, 2019 attached.
Colombian Office Action Oficio N° 5695 dated May 20, 2020 issued in Colombian patent application No. NC2018/0007637 (12 pages) and its partial English-language translation thereof (5 pages).

(Continued)

*Primary Examiner* — Jose A Fortuna
(74) *Attorney, Agent, or Firm* — Wood Herron & Evans LLP

(57) ABSTRACT

A multi-ply fibrous product includes at least two fibrous plies, such as a multi-ply nonwoven product, a tissue paper product or a hybrid thereof including at least two tissue paper plies and/or nonwoven plies including cellulosic fibers. At least two fibrous plies are bonded to each other by an aqueous adhesive composition including an adhesive component and a dermatologically acceptable acid, and optionally a salt thereof. A process for the manufacture of this multi-ply fibrous product includes (a) providing at least two fibrous webs, (c) applying an aqueous adhesive composition including an adhesive component and a water-soluble, dermatologically acceptable acid, and optionally the corresponding salt thereof, to at least one side of at least one fibrous web, d) superimposing at least two webs such that the aqueous adhesive composition is located between at least two superimposed webs, and e) bonding at least two webs together.

13 Claims, 4 Drawing Sheets

(56) References Cited

U.S. PATENT DOCUMENTS

| | | | | |
|---|---|---|---|---|
| 4,824,689 | A * | 4/1989 | Kuenn | A01N 25/34 427/2.31 |
| 4,828,912 | A * | 5/1989 | Hossain | A61K 9/70 428/532 |
| 5,466,318 | A * | 11/1995 | Bjork | B32B 29/00 156/183 |
| 6,238,682 | B1 * | 5/2001 | Klofta | A61K 8/39 424/402 |
| 6,517,849 | B1 * | 2/2003 | Seger | A01N 43/36 424/402 |
| 6,551,691 | B1 | 4/2003 | Hoeft et al. | |
| 7,407,560 | B2 * | 8/2008 | Hilbig | B31F 1/07 156/209 |
| 7,842,163 | B2 * | 11/2010 | Nickel | B31F 1/07 162/109 |
| 8,097,116 | B2 * | 1/2012 | Hedrick | B32B 5/02 156/299 |
| 8,771,578 | B2 * | 7/2014 | Campbell | B31F 1/12 162/111 |
| 9,637,862 | B2 * | 5/2017 | Saas | B31F 1/07 |
| 9,937,694 | B2 * | 4/2018 | McNeil | B32B 5/26 |
| 2003/0129363 | A1 | 7/2003 | Hoeft et al. | |
| 2004/0096489 | A1 * | 5/2004 | Fabo | A61L 15/42 424/449 |
| 2005/0045267 | A1 * | 3/2005 | Muvundamina | C09J 129/04 156/78 |
| 2006/0134445 | A1 * | 6/2006 | Hedrick | B32B 7/12 428/507 |
| 2007/0137813 | A1 * | 6/2007 | Nickel | B31F 1/07 162/109 |
| 2008/0257507 | A1 * | 10/2008 | Campbell | C08G 73/0286 162/111 |
| 2009/0075107 | A1 * | 3/2009 | Hedrick | B32B 5/02 428/507 |
| 2010/0136268 | A1 * | 6/2010 | Rasch | B32B 7/14 428/34.1 |
| 2010/0297377 | A1 * | 11/2010 | McNeil | B32B 37/30 428/43 |
| 2011/0008631 | A1 * | 1/2011 | Lindqvist | B32B 17/02 428/449 |
| 2014/0238596 | A1 * | 8/2014 | McNeil | B32B 37/30 156/292 |
| 2014/0242320 | A1 * | 8/2014 | McNeil | B32B 5/02 428/43 |
| 2015/0184342 | A1 * | 7/2015 | Saas | D21F 11/006 162/132 |
| 2019/0021553 | A1 * | 1/2019 | Saas | B31F 1/07 |
| 2020/0011014 | A1 * | 1/2020 | Pleyber | D21H 27/002 |

FOREIGN PATENT DOCUMENTS

| | | | | |
|---|---|---|---|---|
| RU | 2248809 | C2 | 3/2005 | |
| RU | 2435668 | C1 | 12/2011 | |
| RU | 201110692 | A | 8/2012 | |
| WO | WO-98/57677 | A1 | 12/1998 | |
| WO | WO-01/29315 | A1 | 4/2001 | |
| WO | WO-0228447 | A1 * | 4/2002 | A61L 15/585 |
| WO | WO-2006/068751 | A2 | 6/2006 | |
| WO | WO-2006068751 | A2 * | 6/2006 | B32B 23/02 |
| WO | WO-2007/108725 | A1 | 9/2007 | |
| WO | WO-2008/131071 | A1 | 10/2008 | |
| WO | WO-2017129240 | A1 * | 8/2017 | D21H 27/32 |

OTHER PUBLICATIONS

Chinese Patent Office, Second Office Action issued in CN Application No. 201680080339A, dated Jan. 22, 2021 (with English language translation), 13 pages.

* cited by examiner

MULTI-PLY FIBROUS PRODUCT COMPRISING A LAMINATING ADHESIVE WITH A DERMATOLOGICALLY ACCEPTABLE ACID

CROSS-REFERENCE TO PRIOR APPLICATION

This application is a § 371 National Stage Application of PCT International Application No. PCT/EP2016/051716 filed Jan. 27, 2016, which is incorporated herein in its entirety.

DESCRIPTION

The present disclosure relates to a multi-ply fibrous product, especially a nonwoven product, tissue paper product or hybrid thereof, capable of contributing to a healthy skin pH, in particular to a multi-ply fibrous product wherein the individual plies are bonded to each other by means of an adhesive including a dermatologically acceptable acid, and optionally a salt thereof.

BACKGROUND

Nonwoven- and tissue paper-based materials find extensive use in modern society. Toilet paper, paper towels such as hand towels or household (kitchen) towels, facial tissues, napkins and tissue handkerchiefs are staple items of commerce. These products typically contain cellulosic fibres (papermaking pulp fibers) selected from hardwood types, softwood types and non-wood types like bamboo or *Miscanthus*. These products can also contain a blend of cellulosic and non-cellulosic fibres.

Among the most important physical properties of tissue paper products are their strength, their softness, their absorbency, primarily for aqueous systems, and their lint and dust resistance. These physical properties are generally tuned for addressing common consumer demand.

Tissue paper products typically come in contact with the human skin when being used. For this reason, it has been considered in the art to treat certain tissue paper products such as toilet paper or handkerchiefs with lotions containing various types of skin-care components but also frequently pH-regulating substances. However, facial tissues, napkins or household (kitchen) towels are typically provided without lotion and also in respect of toilet papers or handkerchiefs there is currently a greater demand for lotion-free grades.

In respect of lotion-free products the present inventors have noted that there is a discrepancy between the pH of conventional tissue paper products and the pH of healthy skin. Depending on the origin of the papermaking fibres, the pH of raw tissue paper webs which have not been further processed is either very close to the neutral point (pH of about 6.5), if mainly virgin papermaking fibres have been used, or slightly basic (pH of about 8.5) if a greater proportion of recycled fibres is included. The current pH level of tissue paper products is hence between 6.5 and 8.5 whereas the pH of healthy skin lies in the range between 4.5 and 6.0. This slightly acidic pH is caused by the acid mantle of the human skin. The acid mantle of the human skin is a very fine, slightly acidic film on the surface of the skin acting as a barrier to bacteria, viruses and other potential contaminants that might penetrate the skin. Accordingly, it is important to minimize the impact of external factors on skin pH.

The present inventors noted that it cannot be excluded that, especially during longer or repeated contact with the human skin, conventional lotion-free tissue paper products have a negative impact on the pH of healthy skin. The same applies to nonwoven products including cellulosic fibers.

Accordingly it is desired to provide a multi-ply fibrous product, in particular nonwoven product, tissue paper product or a hybrid thereof, that reduces the likelihood that conventional multi-ply fibrous products change the pH of healthy skin.

It is also desired to provide a multi-ply fibrous product, in particular nonwoven product, tissue paper product or a hybrid thereof, with particularly efficient means to prevent a negative impact of the pH of conventional multi-ply fibrous products on skin pH.

Moreover, it is also desired to provide such a multi-ply fibrous product without adversely affecting other properties related to the use thereof such as delamination strength and/or softness and/or absorbency and/or further properties known in the art.

SUMMARY

In an aspect, a multi-ply fibrous product includes at least two fibrous plies, for example a multi-ply nonwoven product, a tissue paper product or a hybrid thereof, including at least two tissue paper plies and/or nonwoven plies including cellulosic fibers, wherein at least two fibrous plies are bonded to each other by means of an aqueous adhesive composition including an adhesive component and a dermatologically acceptable acid, and optionally a salt thereof.

In another aspect, a process for the manufacture of a multi-ply fibrous product, such as a tissue paper product, includes:

a) providing at least two fibrous webs of tissue paper and/or nonwoven;
b) optionally embossing at least one web in order to provide at least one pattern of protuberances;
c) applying an aqueous adhesive composition including an adhesive component and, in particular embodiments, a water-soluble, dermatologically acceptable acid, and optionally the corresponding salt thereof, to at least one side of at least one fibrous web, wherein, if at least one web is embossed, the aqueous adhesive composition can be applied to the distal ends of at least a part of the protuberances;
d) superimposing at least two webs such that the aqueous adhesive composition is located between at least two superimposed webs;
e) bonding at least two webs together; and
f) optionally further steps for converting the bonded webs to the final multi-ply fibrous product.

Particular embodiments of the multi-ply fibrous product and/or the aqueous adhesive composition are described below and in the claims.

In embodiments of the multi-ply fibrous product as set forth above, said acid and optionally the salt thereof are provided in such an amount that the pH of the multi-ply fibrous product measured according to ISO 6588-1:2012(E) is in the range of from 3.5. to 7, 4 to 6.9, 4.3 to 6.4, or 4.5 to 6.2, e.g. 4.8 to 6.0. (It should be noted that hereinafter the description of broader and narrower ranges also discloses embodiments in which the lower and upper limits are combined in a different manner. For example, the following pH ranges: 3.5 to 6.9, 3.5 to 6.4, 3.5 to 6.2, 3.5 to 6.0, 4.0 to 7.0, 4.3 to 7.0, 4.5 to 7.0, 4.8 to 7.0, 4.0 to 6.4, etc.)

In embodiments, the aqueous adhesive composition contains the acid, and optionally the salt thereof, in a molar amount of 0.1 to 10 mol/1, 0.5 to 5 mol/l, or e.g. 1 to 3 mol/1.

In embodiments, the aqueous adhesive composition is present in an amount, based on the total weight of all ingredients except water, of 0.01 to 2 wt.-%, or 0.1 to 1.3 wt.-%, with respect to the weight of the multi-ply fibrous product.

In embodiments, the adhesive component is selected from (a) natural polymers such as proteins and protein-based compounds, gums and gum-like materials, polysaccharide-based materials, glues derived from animal products and (b) synthetic polymers such as PEI (polyethyleneimine), PAE (polyamidoamin-epichlorhydrine) and PVAm (polyvinylamine), polyvinyl alcohol (PVA), polyvinyl acetate (PVAC), vinyl acetate-ethylene (VAE), polyvinylpyrrolidone (PVP), polyurethanes and styrene-butadiene, and water-soluble or dispersible cellulose-based compounds such as carboxymethyl cellulose, sodium carboxymethyl cellulose, methyl cellulose, and ethyl cellulose; or any combination thereof.

In embodiments, the dermatologically acceptable acid is water soluble, and is selected from (i) inorganic acids such as boric acid; (ii) optionally hydroxylated, organic acids having 2 to 24 carbon atoms, optionally hydroxylated, organic acids having 3 to 6 carbon atoms, or optionally citric acid, lactic acid, isoascorbic acid, or combinations thereof; and (iii) polymeric organic acids such as polyacrylic acid, and combinations thereof. In embodiments, the optionally present salt thereof is the salt corresponding to the selected acid.

In embodiments, the aqueous adhesive composition includes a dermatologically acceptable acid and a salt thereof, and both are present in amounts providing together a pH buffering capacity.

In embodiments, the plies include, as paper-making fibers, (i) only non-recycled cellulosic fibers, (ii) only recycled cellulosic fibers, or (iii) a mixture of non-recycled cellulosic fibers and recycled cellulosic fibers in a weight ratio of 99/1 to 1/99, e.g. 90/10 to 10/90 or 80/20 to 20/80, wherein in any of (i), (ii) or (iii) the cellulosic fibers can be selected from wood fibers such as softwood or hardwood fibers and non-wood fibers such as fibers from annual plants, and combinations thereof.

In embodiments, the number of plies, in particular tissue paper plies, is 2 to 8, in particular 2 to 6, e.g. 2 to 5.

In embodiments, the adhesive composition is applied in at least one regular or irregular pattern to at least a part of the surface of the plies, in particular nonwoven or tissue paper plies, wherein said regular or irregular pattern/s cover/s at least the central area of the fibrous plies, in particular nonwoven or tissue paper plies.

In embodiments, the multi-ply fibrous product is a tissue paper product, has two outer plies, and optionally at least one further ply located therebetween, wherein at least one outer ply is embossed, thereby forming protuberances wherein the aqueous adhesive composition is applied to the distal end of at least a part of the protuberances which are arranged such, as to bond together the two outer plies, and optionally at least one further ply located therebetween.

In embodiments, the multi-ply fibrous product is a tissue paper product, including at least three plies, an embossed upper outer ply, and an embossed lower outer ply, each outer ply including patterns in relief including at least in part discrete protuberances, and a central ply, the distal areas of at least part of the protuberances of each outer ply facing the central ply, and at least one of the upper outer ply and lower outer ply having a pattern density of at least 10, or at least 20 protuberances/cm$^2$, the lower outer ply including a first pattern and a second pattern, the height of the first pattern being less than the height of the second pattern, wherein the central ply and the upper outer ply are joined in a nested mode, and by means of the applied adhesive composition, to said lower outer ply at a level of at least part of the tips of the second pattern of said lower outer ply, wherein the height of the protuberances of the second pattern can be by 50% to 200% greater than the height of the protuberances of the first pattern.

In embodiments, the percentage of the total surface of the multi-ply fibrous product which is bonded by means of the adhesive composition is 1 to 20%, 2 to 10%, or 4 to 8%.

In embodiments, the multi-ply fibrous product is selected from a wipe, a sanitary product such as toilet paper, a paper handkerchief, a household towel, a towel, a tissue for facial use, a napkin/serviette, bed linen or a garment. In certain embodiments, the multi-ply fibrous product is a toilet paper product having 2 to 8 plies, or 2 to 6 plies.

Hereinafter, the use of the terms "comprising" or "including" should be understood as disclosing, as a more restricted embodiment, the term "consisting of" as well, as long as this is technically meaningful.

BRIEF DESCRIPTION OF THE DRAWINGS

In FIG. 1, the following reference numbers represent:

(1) Ply A (1$^{st}$ outer ply),
(2) Ply B (middle ply),
(3) Ply C (2$^{nd}$ outer ply),
(4) Gluing unit,
(5) Gluing chamber,
(6) Anilox roll (engraved),
(7) Applicator roll (flat rubber roller),
(8*a*), (8*b*) Rubber rolls,
(9*a*), (9*b*) Embossing rolls,
(10) Marrying roll,
(11) Three-ply tissue paper product The numbers, as in all figures, apply to all figures. The rotation directions of the different rolls and the advancement direction of the plies are indicated by the arrows.

Figure 2:
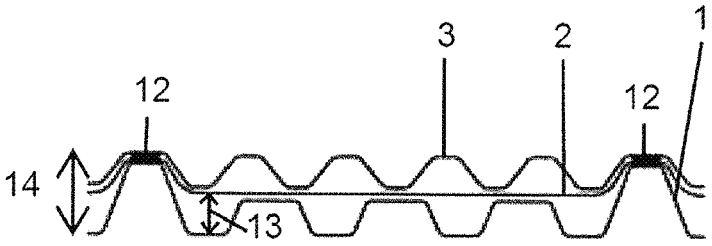

FIG. 2 is a schematic representation illustrating the structure of an embodiment of a three-ply tissue paper product. In FIG. 2, the following reference numbers represent:

(12) Glue (adhesive composition),
(13') Level 1 engraving (micro embossing),
(14) Level 2 engraving (macro-embossing, decorative pattern).

Figure 3A:
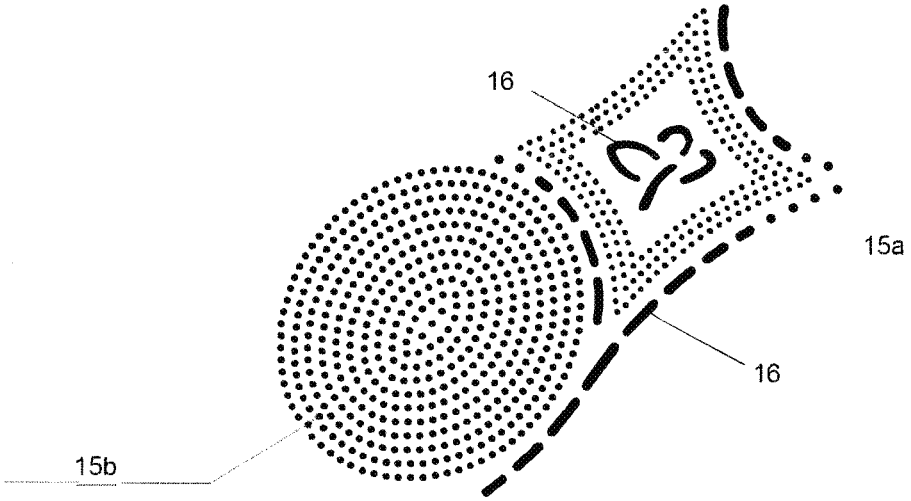
Figure 3B:
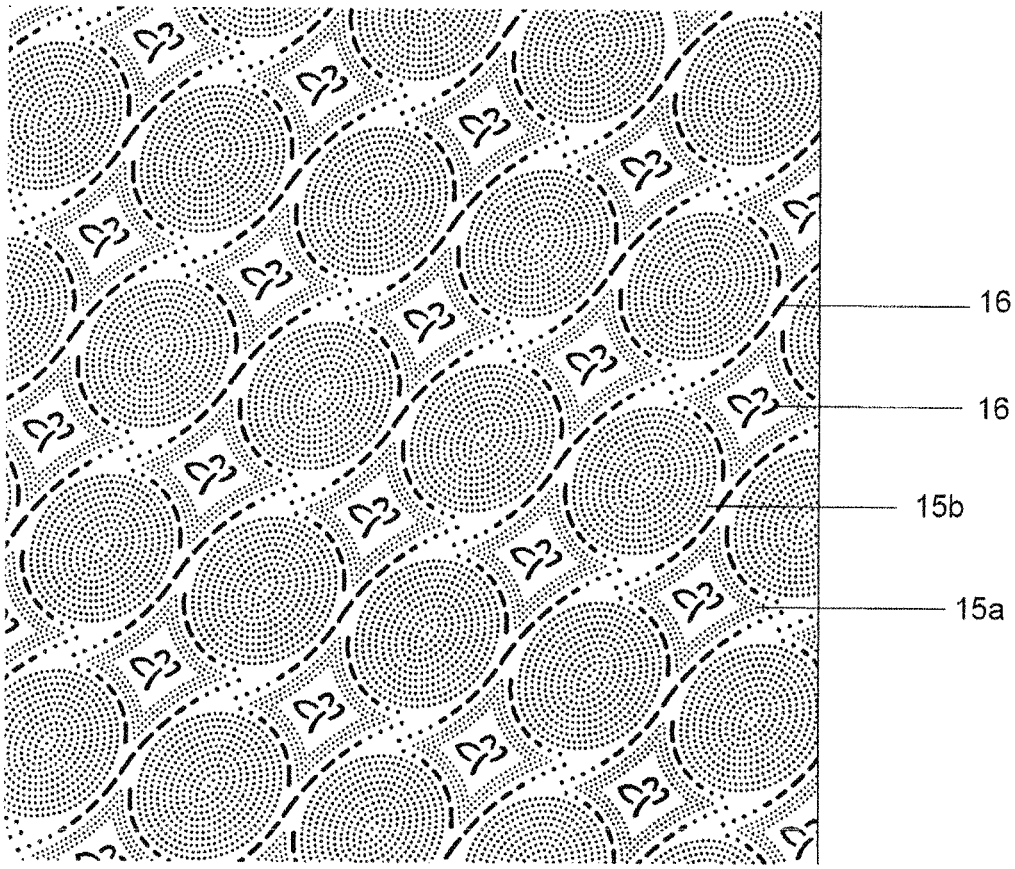

FIGS. 3A and 3B are a schematic representation of the different embossing patterns of the tissue paper product. In FIGS. 3A and 3B, the following reference numbers represent:

(15*a, b*) Micro-embossing pattern,
(16) Macro-embossing pattern.

Figure 1:
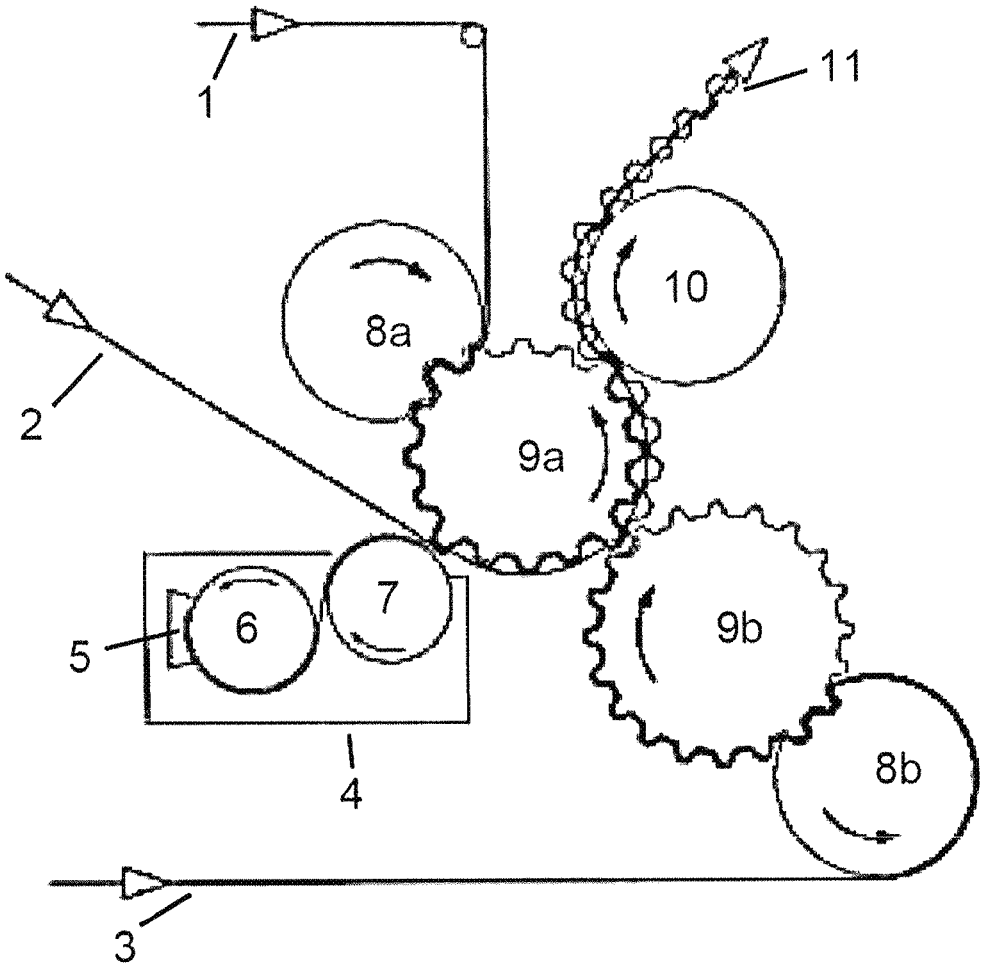
FIG. 1 is a schematic representation illustrating an embossing/gluing station which can be used for manufacturing a three-ply tissue paper product.
Figure 4:
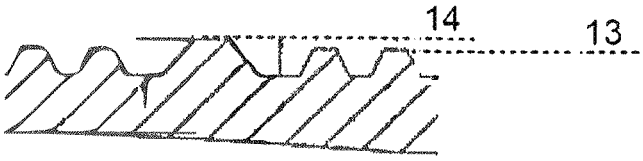

FIG. 4 is a schematic representation of one part of the surface of embossing roll (9*a*) shown in FIG. 1. The two different height levels of engraved protrusions lead to corresponding different embossment levels of the tissue paper product. In FIG. 4, the following reference numbers represent:

(13) Level 1 engraving,
(14) Level 2 engraving.

Figure 5:
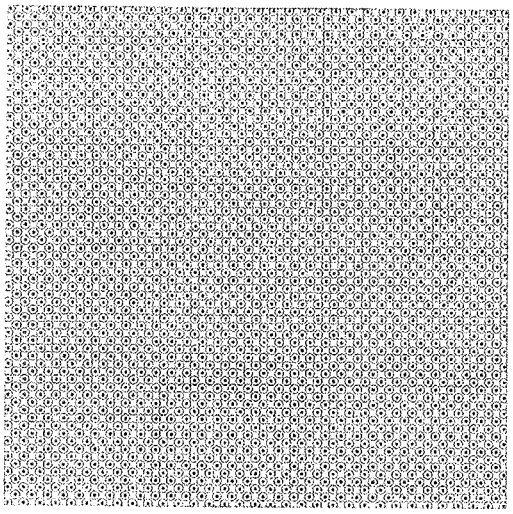

FIG. 5 is a schematic representation of an example of a micro-embossing pattern of the tissue paper product. The dot number is 20/cm$^2$.

DETAILED DESCRIPTION OF PARTICULAR EMBODIMENTS

The present disclosure relates to a multi-ply fibrous product including at least two fibrous plies. In particular embodiments, the multi-ply-fibrous product is selected from:

(a) a multi-ply nonwoven product including at least two nonwoven plies which plies, for example, include cellulosic fibres;

(b) a tissue paper product including at least two tissue paper plies; and (c) a hybrid thereof including at least one tissue paper ply and at least one nonwoven ply, including, for example, cellulosic fibers.

In this multi-ply fibrous product at least two of the aforementioned fibrous plies are bonded to each other by means of an aqueous adhesive composition including an adhesive component and a dermatologically acceptable acid, and optionally a salt thereof.

In a particular embodiment the multi-ply fibrous product is a tissue paper product.

The tissue paper product, nonwoven product or hybrid thereof is composed of two or more plies bonded to each other with a specific adhesive composition.

The term "ply" as used herein refers to distinguishable and typically separable cut-to-size webs of tissue paper as are obtained after processing ("converting") one or more base (raw) tissue paper webs. Each individual ply may include one or more layers, e.g. one, two, three or four layers. In the case of nonwovens, the term "ply" as used herein refers to distinguishable and typically separable cut-to-size webs of nonwoven.

In connection with tissue paper webs the term "layer", as used herein, refers to a stratum within the web having a defined fiber composition. The one or more layers is/are formed by depositing one or more streams of pulp furnishes onto a wire with a pressurized single- or multi-layered headbox. This technique is well known to those skilled in the art. It renders possible the use of different kinds of fibers in each layer of the web.

As used herein, "tissue paper web" is understood to include the one-ply base tissue as obtained from the tissue machine. The tissue paper web is made by a process including the steps of: forming an aqueous suspension of pulp fibers i.e. the so-called "furnish", depositing said aqueous suspension onto a wire to form a wet web, dewatering, drying and creping the web.

The tissue paper web and the resulting ply may have a basis weight of 8 to 50 g/m$^2$, in particular 10 to 30 g/m$^2$, especially 12 to 25 g/m$^2$. The same applies to nonwoven webs and the resulting plies.

Based on the underlying compatibility of the production processes (wet forming), "tissue" production is counted among the papermaking techniques. The production of tissue is distinguished from paper production by its extremely low basis weight and its much higher tensile energy absorption index. Paper and tissue paper also differ in general with regard to the modulus of elasticity that characterizes the stress-strain properties of these planar products as a material parameter.

A tissue's high tensile energy absorption index results from the outer or inner creping. The former is produced by compression of the paper web adhering to a dry cylinder as a result of the action of a crepe doctor or in the latter instance as a result of a difference in speed between two wires ("fabrics"). This causes the still moist, plastically deformable paper web to be internally broken up by compression and shearing, thereby rendering it more stretchable under load than an uncreped paper. A high tensile energy absorption index can also be achieved by imparting to the tissue a 3D structure by means of the wires themselves. Most of the functional properties typical of tissue and tissue products result from the high tensile energy absorption index (see DIN EN 12625-4 and DIN EN 12625-5).

The tissue paper can be produced from paper-making fibers according to "Conventional Processes" as in the manufacture of "Dry Crepe Tissue" or "Wet Crepe Tissue" or "Processes for Structured Tissue" such as the Through Air Drying (TAD) manufacturing method, the manufacture of uncreped through-air dried (UCTAD) tissue, or alternative manufacturing methods, e.g. the Advanced Tissue Molding System (ATMOS) of the company Voith, or Energy Efficient Technologically Advanced Drying eTAD of the company Georgia Pacific, or Structured Tissue Technology SST of the company Metso Paper. Hybrid processes like NTT (New textured Tissue) which are alterations of the conventional processes can be used, too.

The conventional dry crepe manufacturing method includes:

- pressing and drying the wet paper fibers as a sheet on a large-diameter, heated cylinder (also called Yankee dryer); and
- subsequently detaching and creping the sheet of dried paper fibers by means of a metal blade applied against said cylinder, across its direction of rotation.

The creping operation creates undulations in the sheet across its direction of travel. The creping operation increases the thickness of the sheet, and confers elasticity and gives touch (soft touch) properties to the sheet.

The TAD manufacturing method includes:

- molding the sheet of wet paper fibers on a fabric; and
- subsequently drying the sheet, at least partly, by means of a current of hot air passing through it.

Subsequently, the dried sheet may be creped.

Further, in the manufacture of the tissue web to be used, a process as described in PCT/EP2015/059326 (application date: 29 Apr. 2015; title: "Tissue paper comprising pulp fibers originating from *Miscanthus* and method for manufacturing the same", incorporated by reference) can be used. Specifically reference is made to the description and details of the TAD process (e.g. 3-D-shaped fabric, permeable drying cylinder, etc.) disclosed therein. The parameters described in this passage are also valid for the use of the ATMOS technology.

Once, the tissue paper has been manufactured, a distinct manufacturing operation called converting operation is typically employed to form the tissue paper product (i.e. the paper towel, toilet tissue rolls, bathroom tissue, wiping tissue, kitchen tissue rolls, handkerchiefs, etc. . . . ).

The term "nonwoven" is very common in the art and can be further defined in the manner described in ISO 9092: 2011, for use herein. Typical nonwoven manufacturing techniques include the air laid technology, spun laid technology, dry laid technology, and wet laid long fibers technology.

According to an embodiment, each of the nonwoven plies used in the multi-ply fibrous product (i.e. multiply nonwoven product or the nonwoven/tissue hybrid) includes cellulosic fibres. In this case, the content of the cellulosic fibres, based on the total weight of all fibres present in the respective ply, is at least 20 wt.-%, at least 50 wt.-%, or at least 80 wt.-%. The remaining fibers are in these cases non-cellulosic fibers such as synthetic fibers.

According to an embodiment, the fibrous multi-ply product includes at least one, or at least 2 textured nonwoven plies. The manufacture of textured nonwoven webs which can be used as nonwoven ply/plies has been described for instance in WO2014/009784 (incorporated by reference). Referring to FIG. 12 of this international application, a particular embodiment of the textured nonwoven is produced as follows:

A reel of fluff pulp 30 is used as raw material. It is fed into crusher 31. The fluff pulp is defibrized into fluff or free papermaking fibers 32. Other raw material may be used, for example blend of fluff pulp and synthetic fibers, artificial fibers or other natural fibers (for instance cellulosic fibers), or thermo-bonded fibers. The papermaking fibers 32 are fed into a given number of (for example two) forming chambers 33. In the forming chambers 33, the papermaking fibers 32 are transported by means of an air flow. The papermaking fibers 32 are deposited onto a forming fabric 34 that travels in loop below the forming chambers 33. Nearly before leaving the forming fabric 34, the formed web is compacted by a compactor 35. The compacted web resulting from this step is then transferred from the forming fabric 34 onto a transfer fabric 36. A binder is sprayed onto one side of the compacted web by a first binder sprayer 37. The binder is a latex composition such as an ethylene and vinyl acetate copolymer composition. Then, the compacted web is dried into a first drying unit 38 (e.g. at a temperature of approximately 110-120° C.). Subsequently, the compacted web is calendered by means of a calendering section 39. The calendering section 39 includes calendering rollers 40 and a mating cylinder 41 in vis-à-vis, both rotating in opposite directions. The calendering roller 40 can be a calendering roller including a positive pattern. The mating cylinder 41 may be a roller having a smooth surface (the mating cylinder may be made from steel or rubber material). The calendering roller may be heated. A calendered web 42 results from this step. A binder (e.g. latex) is sprayed onto the other side of the calendered web 42 by a second binder sprayer 43. As an alternative to the use of a binder sprayed by the first and second binder sprayers 37, 43, thermo-binding fibers (e.g. thermo-bonded fiber or thermo-bonded fiber and latex) can be used and mixed with papermaking fibers into the forming chambers 33. Then, the calendered web 42 is dried and cured into a second drying unit 44 (e.g. at a temperature of approximately 200° C.). The resulting web 42 is further cured and cooked by the means of a third drying unit 45 (e.g. at a temperature of approximately 200° C.). The calendered web resulting from the above steps forms a textured nonwoven fabric including papermaking fibers 46. It may be wound onto a reel 50 as a roll of textured nonwoven fabric including papermaking fibers. The reel 50 of textured nonwoven fabric including papermaking fibers may then be fed into a converting unit 60 in order to produce napkins, paper towels, toilet paper rolls, facial rolls, wiping paper products, kitchen towel rolls, skin care or cleaning wipes, handkerchiefs, etc. . . . .

The paper-making fibers (in the following also referred to as "cellulosic fibers") can be produced from virgin and/or recycled paper pulp raw material. The cellulosic fibres to be used may contain as main structure-building component the long chain fibrous cellulose portion which is present in naturally occurring cellulose-containing cells, in particular those of lignified plants. In particular embodiments, the fibres are isolated from lignified plants by digestion steps removing or reducing the content of lignin and other extractables and optional bleaching steps. The cellulosic fibres can also stem from non-wood sources such as annual plants.

The cellulosic fibres to be used may be of regenerated type (e.g. Lyocell), although the use of other types of pulps may be preferred. The pulps employed can be a primary fibrous material ("virgin fibers") or a secondary fibrous material (recycled pulps). The pulp can stem from lignin-free or low lignin sources, such as cotton linters, esparto (alfa) grass, bagasse (e.g. cereal straw, rice straw, bamboo, or hemp), kemp fibres, *Miscanthus* grass fibers, or flax (also referred to as "non-wood fibers" in the description and the claims). In particular embodiments, the pulp is produced from ligno-cellulosic material, such as softwood (which typically originates from conifers) or hardwood (typically from deciduous trees).

It is possible to use "chemical pulps" or "mechanical pulps", whereby the use of chemical pulps may be preferred.

As used herein, "chemical pulps" are, according to DIN 6730, fibrous materials obtained from plant raw materials of which most non-cellulosic components have been removed by chemical pulping without substantial mechanical post treatment. As used herein, "mechanical pulp" is the general term for fibrous material made of wood entirely or almost entirely by mechanical means, optionally at increased temperatures. Mechanical pulp can be sub-divided into the purely mechanical pulps (groundwood pulp and refined mechanical pulp) as well as mechanical pulps subjected to chemical pre-treatment, such as chemo-mechanical pulp (CMP), or chemo-thermo mechanical pulp (CTMP).

Typical properties of tissue paper include the ready ability to absorb tensile stress energy, their drapability, good textile-like flexibility, properties which are frequently referred to as bulk softness, a high surface softness, a high specific volume with a perceptible thickness, as high a liquid absorbency as possible and, depending on the application, a suitable wet and dry strength as well as an interesting visual appearance of the outer product surface. These properties allow tissue paper to be used, for example, as cleaning cloths (e.g. household towels), sanitary products (e.g. toilet paper, hand towels), paper handkerchiefs, cosmetic wipes (facial tissues) or as serviettes/napkins.

In particular embodiments, aqueous adhesive composition used to bond at least two fibrous plies such as tissue paper plies and/or nonwoven plies together includes (i) an adhesive component and (ii) a dermatologically acceptable acid, and optionally the corresponding salt thereof. In one embodiment, the remainder is water. The "aqueous adhesive composition" can also be referred to and described as "water-based adhesive" including a dermatologically acceptable acid, and optionally the corresponding salt thereof.

As used herein, the term "adhesive component" is to be understood as the one or more chemical substance(s) that correspond to the non-aqueous component/s of water-based adhesives suitable for bonding/laminating fibrous webs of tissue paper and/or nonwoven. This adhesive component can include an adhesive polymer as main component (more than 50 wt. %, e.g. more than 80 wt. %, based on the total weight of the adhesive component) or as sole component. Besides the adhesive polymer, the adhesive component may include common auxiliary substances used in water-based adhesives such as tackifiers, viscosity-adjusting substances or dispersion aids.

The aqueous adhesive composition may also contain a colorant which can be used to make the applied pattern of adhesive composition visible.

In particular embodiments, the solid content of the adhesive component in the aqueous adhesive composition is 2 to 50 wt.-%, 2.5 to 20 wt.-%, or e.g. 3 to 10 wt.-%.

The adhesive polymer can be a natural polymer or a synthetic polymer and is soluble or dispersible in the final aqueous adhesive composition. The natural polymer can be made from sources such as (i) proteins and protein-based compounds such as casein, soya proteins, zein, and gelatin, (ii) gums and gum-like materials such as gum arabic, gum tragacanth, gum ghatti, Indian gum, mucilage and the like, (iii) polysaccharide-based materials such as starch and processed starch, dextrins, agar, pectin, and the like or (iv) glues derived from animal products such as hides, bones, and fish offal. The synthetic polymers can be selected from PEI (polyethyleneimine), PAE (polyamidoamin-epichlorhydrine) and PVAm (polyvinylamine), polyvinyl alcohol (PVA), polyvinyl acetate (PVAC), vinyl acetate-ethylene (VAE), polyvinylpyrrolidone (PVP), sodium polyacrylate, polyethylacrylate, polymethacrylic acid, polyurethanes and styrene-butadiene, and water-soluble or -dispersible cellulose-based compounds such as carboxymethyl cellulose, sodium carboxymethyl cellulose, methyl cellulose, and ethyl cellulose, or any combination thereof. In particular embodiments, the synthetic polymer is a polyvinyl alcohol polymer or water-soluble or water-dispersible cellulose-based compound. The natural polymer or synthetic polymer can be of any water-soluble or water-dispersable molecular weight sufficient to form an adhesive. In general, the adhesive polymer, i.e. the natural polymer or synthetic polymer, may have a weight average molecular weight of from about 40,000 to about 120,000, or from 70,000 to 90,000 (as determined by GPC).

The dermatologically acceptable acid (which may also be referred to as "skin-compatible") can be water-soluble. In embodiments, the solubility in water (at 25° C.) is at least 1 g/L, in particular and with increasing preference at least 10 g/L, at least 50 g/L, at least 100 g/L.

In embodiments, the acid is selected from (i) inorganic acids such as boric acid, (ii) organic, optionally hydroxylated, acids having 2 to 24 carbon atoms, and (iii) polymeric organic acids such as polyacrylic acid. Optionally, each of these acids is combined with a salt thereof, in particular a metal salt thereof to form a buffer.

In embodiments, the salt-forming metal is selected from alkali and alkaline earth metals including, but not limited to, sodium, potassium, calcium, and other. Thus, in one example, when the chosen acid is lactic acid, suitable metal salts thereof would include sodium lactate and potassium lactate.

In embodiments, the organic, optionally hydroxylated, acid according to item (ii) has 2 to 18, 3 to 10, or in particular 3 to 6 carbon atoms, and can be saturated or unsaturated. The organic, optionally hydroxylated, acid according to item (ii) can be a mono- or poly (e.g. di-) carboxylated acid. In particular embodiments, the organic, optionally hydroxylated, acid according to item (ii) is selected from citric acid, lactic acid, isoascorbic acid, glycolic acid, malic acid, tartaric acid, glycolide (a cyclic dimer of a glycolic acid which hydrolyzes to form two glycolic acid molecules), acetic acid, dehydroacetic acid, oleic acid, palmitic acid, stearic acid, behenic acid, palm kernal acid, tallow acid, salicylic acid, ascorbic acid, sorbic acid, benzoic acid, succinic acid, or any combinations thereof.

In particular embodiments, the acids are saturated and hydroxylated and include citric acid, lactic acid, isoascorbic acid or any combinations thereof. In yet more particular embodiments, the acid is lactic acid together with a corresponding metal salt, such as sodium lactate or potassium lactate.

As mentioned before, acids and salts of the corresponding acids could be added together (e.g. lactic acid and sodium lactate) to provide a "buffering" effect, which helps to keep the desired pH stable. Accordingly, it can be preferred to make use of an aqueous adhesive composition including both a dermatologically acceptable acid and a salt thereof while both are present in amounts providing a pH buffering capacity.

In one embodiment of the multi-ply fibrous product, said acid and optionally the salt thereof are provided in such an amount that the pH of the multi-ply fibrous product, such as the tissue paper, nonwoven or hybrid product measured according to ISO 6588-1:2012(E) is in the range of from 4.3 to 6.4, 4.5 to 6.2, or e.g. 4.8 to 6.

In one embodiment, the aqueous adhesive composition contains the acid and optionally the salt thereof in a molar amount of 0.1 to 10 mol/1, 0.5 to 5 mol/l, or e.g. 1 to 3 mol/1.

In embodiments, the pH (measured at 25° C.) of the aqueous adhesive composition is 1 to 6, 1.5 to 4, or 2 to 3.

In one further embodiment, the aqueous adhesive composition has been applied to the multi-ply fibrous product, in particular a nonwoven or tissue paper product or a hybrid thereof, such as a tissue paper product, and is present therein in an amount (based on the total weight of all ingredients except water) of 0.01 to 2 wt.-%, or 0.1 to 1.3 wt.-%, with respect to the weight of the multi-ply fibrous product. These values can be calculated by dividing the amount of aqueous adhesive composition (total weight of all ingredients except water) applied to the tissue paper product, expressed as $g/m^2$, through the basis weight of the dry tissue paper product which is also expressed as $g/m^2$. As used herein, "dry" tissue paper means conditioned as specified below in the experimental section.

The aqueous adhesive composition may have a viscosity of 1 to 500 mPa·s, or 1 to 200 mPa·s measured at 25° C. using the viscosimeter Brookfield LV-DV-I from Brookfield Engineering Laboratories, Inc. using the spindles and rotational speeds given in the experimental section. Alternatively, the viscosity may be adjusted to the range of 25 to 150 mPa·s, or 70 to 125 mPa·s.

Since the addition of a dermatologically acceptable acid, e.g. lactic acid to the adhesive composition can have an influence on the viscosity thereof, and thereby on the handling and application properties of the adhesive composition, it can be preferred to use an amount of acid leading to viscosities within these ranges.

According to the further embodiments, the plies of the multi-ply fibrous product include, as paper-making fibers, (i) only non-recycled cellulosic fibers, (ii) only recycled cellulosic fibers, or (iii) a mixture of non-recycled cellulosic fibers and recycled cellulosic fibers in a weight ratio of 99/1 to 1/99, e.g. 90/10 to 10/90 or 80/20 to 20/80, wherein in any of (i), (ii) or (iii) the cellulosic fibers can be selected from wood fibers such as softwood or hardwood fibers and non-wood fibers such as fibers from annual plants, and combinations thereof. Since fibrous products made from recycled cellulosic fibers tend to have higher pH values, greater amounts of acid may be required to prevent a negative impact on natural skin pH.

Depending on the type of multi-ply fibrous product, the number of fibrous plies such as tissue paper plies and/or nonwoven can be 2 to 8, in particular 2 to 6, e.g. 2 to 5. In very thick products having higher ply numbers, the adhesive composition is usually not added to one of the outer plies to bond all plies together but to the 2nd or 3rd ply (if there are 2 or 3 inner plies located between the two outer plies). The adhesive will then migrate from the ply to which it has been applied to the other plies, either automatically if the plies are superimposed and brought into contact with each other, or at the latest if pressure is applied (typically in a roll nip) to those areas carrying the adhesive composition. In this manner, all plies can be bonded together.

The aqueous adhesive composition can be applied to the entire surface, or a part thereof, in so-called "application zones". Within these application zones the adhesive composition may be applied as a continuous coating or in the form of one or more regular or irregular patterns. Regular patterns can for instance be generated by combined adhesive/mechanical (e.g. by embossing) ply-bonding techniques explained below. The application zone, or the sum of all application zones, may constitute at least 50%, or at least 80% of the surface area of the multi-ply fibrous product. In particular embodiments, the application zone includes the central area of the multi-ply fibrous product which most likely comes into contact with the skin of the user.

The pattern/s may include/s discrete and/or partially overlapping elements such as dots, circles, lines, stripes, curves, polygons, etc. which may form design elements such as flowers, leaves, etc.

In particular embodiments, the adhesive composition is applied in a pattern, such as in a pattern that coincides partially or fully with a pattern of protuberances resulting from embossing at least one ply. In one embodiment of the multi-ply fibrous product (e.g. toilet paper), at least one outer ply this embossment pattern on substantially at least 50%, or at least 80% of its surface, which may include the central area of the multi-ply fibrous product.

In one embodiment, the multi-ply fibrous product shows an essentially even coverage by the aqueous adhesive composition over its surface. As used herein, "coverage" means the distribution of an aqueous adhesive composition by means of at least one regular or irregular pattern (i.e. one or two regular patterns) between at least two plies of the multi-ply product. This "coverage" can include the central area of the multi-ply fibrous product.

The adhesive composition can be applied by techniques usual in the art such as spraying, roll application, printing, using a non-contact application system as developed, e.g. by WEKO (Weitmann & Konrad GmbH & Co. KG), or slot die application.

After the application of the aqueous adhesive composition, no specific drying step is required. Typically, the fibrous plies, such as tissue paper plies and/or nonwoven, will adsorb the free water content of the aqueous adhesive composition. In addition, some water may also evaporate when the multi-ply fibrous product is left standing at the air.

In embodiments, at least two, or, in particular embodiments, all fibrous plies such as tissue paper plies and/or nonwoven plies are combined together by using an aqueous adhesive composition including an acid or a buffer system, or by combining adhesive ply bonding with mechanical ply bonding (e.g. by knurling or embossing). During adhesive bonding, a film of adhesive is deposited over the entire surface area, or a part thereof, of at least one of the plies, then the adhesive-treated surface is placed in contact with the surface of at least one other ply, as explained below in further detail. Two plies are bonded together by applying the adhesive composition to the inner side of one of the two plies. When more than two plies are to be bonded together it is frequently also sufficient to apply the adhesive composition only to one of these plies, e.g. onto the inner side of one of the two outer plies, because the adhesive composition will migrate to the other plies as well and bond all plies together, especially if adhesive ply bonding is combined with mechanical ply bonding and the application of pressure to those areas carrying the adhesive composition. During the mechanical combination, the plies may be combined by knurling, or by compression, or by embossing. Embossing is a process by which a raised or depressed design is produced, generally by pressure between engraved rolls or plates or between an engraved roll or plate and an elastic or a deformable supporting surface. This can result for example in a dry crepe tissue ply having a particular relief or indentation. The thickness of the dry crepe tissue ply or of the multiple plies is increased after embossing compared with its initial thickness.

In one embodiment, the multi-ply fibrous product, such as tissue paper product, nonwoven product or hybrid thereof, has two outer plies, and optionally further plies located therebetween, wherein at least one outer ply is embossed, thereby forming protuberances and wherein the aqueous adhesive composition is applied to the distal end of at least a part of the protuberances which are arranged such as to bond together the two outer plies, and optionally further plies located therebetween. In this embodiment, the lower outer ply may also be "flat", i.e. free of protuberances resulting e.g. from embossing, while the aqueous adhesive composition is only applied to the distal ends of protuberances of the upper outer ply in order to join the outer plies (and e.g. an optionally present center ply) together.

Some techniques for embossing fibrous plies, in particular nonwoven plies including cellulosic fibers or tissue paper plies in combination with the application of the aqueous adhesive composition are explained below.

For manufacturing multi-ply fibrous products, especially tissue products, especially bathroom tissue and household tissue, known manufacturing methods for embossing and adhesively bonding of the plies can be used such as the Goffra Incolla/spot embossing, DESL (Double Embossing Single Lamination), and Pin-to-Pin/Foot-to-Foot. Before ply bonding, the plies are often embossed in nips of an embossing roll and an anvil roll.

In the first mentioned manufacturing method, Goffra Incolla, a first web is directed through the nip between an embossing roll and an anvil roll. In this nip, the web is provided with an embossing pattern. Thereafter, an application roll applies adhesive to those parts of the first web at which there are protruding embossing elements in the embossing roll. The adhesive is transported from an adhesive bath via an adhesive transfer roll to the application roll. A second web is transported to the first web and adhesively bonded to the first web in the nip between the so-called marrying roll and the embossing roll. The adhesive bonding takes place at those portions at which the adhesive was applied.

The second manufacturing method (DESL) is very similar to the above-described Goffra Incolla method. It includes an additional pair of rolls including a second embossing roll and a second anvil roll. The additional pair of rolls serves to emboss the second web before it is adhesively bonded to the first web using the marrying roll. Typically, the additional pair of rolls is placed close to the first pair of rolls and the marrying roll. In one special case of the general DESL-manufacturing method, the embossing elements of the first embossing roll and the embossing elements of the second embossing roll are arranged such that the embossed elements of the first embossed ply and the embossed elements of the second embossed ply fit into each other similar to a gearing system. This serves to achieve a mutual stabilization of the two plies. However, for the DESL manufacturing method such correlation between the embossed elements of the first, upper ply and the second, lower ply, is not required.

The third manufacturing method (Pin-to-Pin/Foot-to-Foot) is similar to the DESL method. By means of two pairs of rolls both the upper ply and the lower ply are embossed, respectively. Adhesive is applied onto the embossed protrusions ("protuberances") of the first ply. The ply bonding, however, is not achieved by means of a marrying roll as in the DESL method but is achieved directly by means of the protruding embossing elements of the second embossing roll. In order to achieve this, an exact adjustment of the width of the gap between the first embossing roll and the second embossing roll is required, which is mainly defined by the individual thickness of both webs (upper ply and lower ply). Further, the embossing rolls have to be designed such that at least some of the protruding embossing elements of both rolls face each other. This is the reason why the terminology Pin-to-Pin or Foot-to-Foot embossing is used.

Further knurling can be used.

One suitable lamination technique has been described in WO 2011/035803 and leads to a 3 ply fibrous product including a middle ply nesting with its protuberances into the pillow-like chambers of the first ply and a bottom ply which can be free of protuberances.

One particular lamination technique is shown in the appended Figures and explained in the examples and is related to the teaching of US 2003/0129363 assigned to Georgia Pacific France. This embodiment, also illustrated by FIGS. 1 to 4, concerns a fibrous multi-ply product, such as tissue paper product, nonwoven product or hybrid thereof, including three plies, i.e. an embossed upper outer ply (3), and an embossed lower outer ply (1), each outer ply (1,3) including patterns in relief including at least in part discrete protuberances, and a central ply (2), the distal areas of at least part of the protuberances of each outer ply (1,3) facing the central ply, and at least one of the upper outer ply (3) and lower outer ply (1) having a pattern density of at least 10, or at least 20 protuberances/$cm^2$, the lower outer ply (1) including a first pattern (15*a*, 15*b*) and a second pattern (16), the height (13) of the first pattern being less than the height (14) of the second pattern, wherein the central ply (2) and the upper outer ply (3) are joined in a nested mode, and by means of the applied adhesive composition (12), to said lower outer ply (1) at a level of at least part of the tips of the second pattern of said lower outer ply, wherein the height of the protuberances of the second pattern can be 50% to 200% greater than the height of the protuberances of the first pattern.

In an embodiment, applying the aqueous adhesive composition is in a manner that the "gluing surface" (or "bonded surface") is in a range of 1 to 20%, 2 to 10%, or 4 to 8%. As used herein, "gluing surface" means the proportion of the total surface of the outer plies of the multi-ply fibrous product including at least two fibrous plies, for example a multi-ply nonwoven product, a tissue paper product or a hybrid thereof, that is bonded to each other or, if applicable, to one or more inner plies, by means of the aqueous adhesive composition. If there are two gluing units or more applying a blend acid/glue to one or more fibrous plies e.g. tissue paper plies and/or nonwoven plies, in different not-overlapping patterns, the respective gluing surfaces are added. Referring e.g. to FIG. 2, the "gluing surface" can be determined (e.g. visually, or with the aid of a microscope) by adding the individual adhesively bonded areas (12), which correspond to the macro embossed areas (16) shown in FIGS. 3A and 3B, and dividing the sum thereof through the total surface area (plan view) of the tissue paper product. Referring e.g. to the design shown in FIGS. 3A and 3B, the "gluing surface" in % can also be calculated by dividing the total area of the macro embossing (16), as plan 2-dimensional view, through the total surface of the fibrous product.

Various techniques exist in the art to adjust the amount of aqueous adhesive composition applied on the multi-ply fibrous product. If, as explained above, the aqueous adhesive composition is applied to the distal ends of at least a part of the protuberances (resulting from embossing), the aqueous adhesive composition can be supplied to the embossing unit by an arrangement of rolls shown in FIG. 1. This arrangement involves roll (6) with an engraved surface, e.g. an anilox roll and applicator roll (7), e.g. a rubber roll with an even surface. In this case, the amount of aqueous adhesive composition can be adjusted by (i) changing the surface volume of the engraved cells of roll (6) to values ranging from 9 to 30 $cm^3/m^2$ (for example volumes: 18 to 21 $cm^3/m^2$) and/or (ii) adjusting the speed of engraved roll (6) to values of 3 to 40% of the line speed (for example speed: 7 to 15%, e.g. 10%).

The multi-ply fibrous product, such as tissue paper product, nonwoven product or hybrid thereof, such as tissue paper product, can be selected from a wipe, a sanitary product such as toilet paper, a paper handkerchief, a household towel, a towel, a tissue for facial use, a napkin/serviette, bed linen or a garment. In particular embodiments, the multi-ply fibrous product is a toilet paper having 2 to 8 plies, or 2 to 6 plies.

In an aspect, provided is a process for the manufacture of a multi-ply fibrous product, such as a tissue paper product, nonwoven product or hybrid thereof, including:

a) providing at least two fibrous webs, such as tissue paper and/or nonwoven webs, for example at least two tissue paper webs,
b) optionally embossing at least one web in order to provide at least one pattern of protuberances,
c) applying an aqueous adhesive composition including an adhesive component and a water-soluble, dermatologically acceptable acid, and optionally the corresponding salt thereof, to at least one side of at least one fibrous web, wherein, if at least one web is embossed, the aqueous adhesive composition can be applied to the distal ends of at least a part of the protuberances,
d) superimposing the at least two webs in a manner that the aqueous adhesive composition is located between at least two superimposed webs,
e) bonding the at least two webs together, and
f) optionally further steps for converting the bonded webs to the final multi-ply fibrous product.

As to steps a) to e) reference can be made to the previous description of the multi-ply fibrous product, such as a tissue paper product, nonwoven product or hybrid thereof, and its manufacture.

The combination of several plies (at least two) can be used to confer to the final multi-ply fibrous product particular properties such as thickness, bulkiness, softness, and strength.

When processing the bonded fibrous webs, e.g. tissue paper webs and/or nonwoven webs including cellulosic fibers, to the final product (optional converting step f), the following steps can be used individually or in combination: cutting to size (longitudinally and/or cross cutting) folding, imprinting, perforating, application of lotions, smoothing, stacking, rolling up and packaging.

EXAMPLES

The following test methods were used to evaluate the tissue papers produced. The test samples were conditioned for at least 12 hours at 50% relative humidity and 23° C. prior to testing. As used herein, reference to the weight of the raw tissue paper or the tissue paper product, the weight has can be determined after conditioning in the above-explained manner.

4.1. Basis Weight

The basis weight was determined according to EN ISO 12625-6:2005, Tissue Paper and Tissue Products, Part 6: Determination of grammage.

4.2. Caliper

The measurement is made by a precision micrometer (precision 0.001 mm) according to a modified method based on EN ISO 12625-3:2014, Part 3. For this purpose, the distance created by a sample between a fixed reference plate and a parallel pressure foot is measured. The diameter of the pressure foot is 35.7+0.1 mm (10.0 $cm^2$ nominal area). The pressure applied is 2.0 kPa+0.1 kPa. The pressure foot is movable at a speed rate of 2.0+0.2 mm/s.

A usable apparatus is a thickness meter type L & W SE050 (available from Lorentzen & Wettre, Europe).

The base tissue (web) to be measured is cut into pieces of 20×25 cm and conditioned in an atmosphere of 23° C., 50% RH (Relative Humidity) for at least 12 hours. For the measurement, a stack of 10 base tissue paper sheets is prepared and placed beneath the pressure plate, which is then lowered. The thickness value for the stack is then read off 5 seconds after the pressure has been stabilized. The thickness measurement is then repeated nine times with further samples treated and prepared in the same manner.

The mean value of the 10 values is taken as thickness of 10 base tissue sheets measured (in the following referred to as "10-ply caliper").

The finished product to be measured (i.e. a one-ply or multi-ply tissue paper product) is cut into pieces of 20×25 cm and conditioned in an atmosphere of 23° C., 50% RH for at least 12 hours.

For the measurement, one sheet is placed beneath the pressure plate which is then lowered. The thickness value for the sheet is then read off 5 seconds after the pressure has been stabilized. The thickness measurement is then repeated nine times with further samples treated in the same manner.

The mean value of the 10 values obtained is taken as thickness of one sheet ("one-sheet caliper") of the finished product (e.g. a two-ply hand towel) measured.

4.3. Viscosity

The viscosity of the composition was measured at 25° C. using the viscosimeter Brookfield LV-DV-I from Brookfield Engineering Laboratories, Inc. Depending from the expected range of viscosities, the following spindles (sp) and rotational speeds (v) are used:

| | | |
|---|---|---|
| sp 1/v 100 rpm | for | $x < 0.1$ Pa s |
| sp 2/v 100 rpm | for | 0.1 Pa s $< x <$ 1 Pa s |
| sp 3/v 100 rpm | for | 1 Pa s $< x <$ 6 Pa s |
| sp 4/v 100 rpm | for | $x > 6$ Pa s. |

4.4 pH Measurement (Raw Tissue Paper/Tissue Paper Product)

As used herein, the following test method can be used to measure the pH of the tissue paper products.

ISO 6588-1:2012(E)—cold extraction methodology

This method is based on the extraction of a representative sample of the respective tissue paper product (2 g) with water of high purity (100 mL) at a temperature between 20 and 25° C. for 1 h. The extract was prepared, filtered and was treated in accordance with this international standard. The pH of the extract was measured at a temperature between 20 C and 25 C. The method yields the average pH of the entire tissue paper product.

4.5 pH Measurement on Skin

Flat Electrode Methodology

Skin surface pH studies were conducted to study the effects of the low pH tissue products on skin pH. Measurements were made on the volar forearm before and after application of the test product. Skin surface pH was measured using a flat-surface electrode, calibrated in standard buffer solution at pH 4.0 and pH 7.0. The electrode was dipped in 0.9 wt % NaCl in deionized water before each measurement. 200 μL of 0.9 wt % NaCl was added to the skin and wiped using the tissue paper of embodiments of the invention. Using a five-person panel, the tissue paper products of embodiments of the invention were tested for their effect on the skin surface pH of the forearm.

Example 1

Preparation of Aqueous Adhesive Composition

About 1 l of a potassium lactate buffer with a pH of 2 was prepared by dissolving 85% lactic acid (264 g, 15% water) and KOH (5 g) in $H_2O$ (736 g). The molar content ("molarity of acid") of lactic acid calculated from these values was 2.366 mol/l. The molarity of the acid refers to the total amount of added acid irrespective of whether a part thereof is present as lactate due to the addition of KOH.

Then, the buffer solution was mixed with 429 g of an aqueous polyvinylalcohol-based adhesive (Swift®tak 1004, solid content of ca. 18.0%; available from H.B. Fuller, Europe, pH ca. 4.5), and resulting in a ratio of 70 wt.-% potassium lactate buffer solution to 30 wt.-% Swift®tak 1004. After mixing the solid content of the adhesive component was ca. 5.4 wt-% based on the entire aqueous adhesive composition. The resulting aqueous adhesive composition had a pH of ca.2.3.

Manufacture of Tissue Paper Product

Raw tissue paper webs produced in a conventional dry crepe process, non-embossed having a caliper of 0.37 mm/sheet and a basis weight of 56.8 g/m2 were prepared from a pulp mixture.

The roll paper was composed of three plies using only papermaking fibers of non-recycled (virgin) type (100% of virgin fiber). The ply composition was as follows:

- two outer plies made from 9% softwood Kraft fibers, 88% eukalyptus Kraft fibers and 3% other hard wood Kraft fibers;
- one inner ply made from 73% softwood Kraft fibers, 20% hardwood Kraft fibers and 7% CTMP.

The raw tissue paper webs had a pH, as measured by ISO 6588-1:2012(E) of 7.7.

Ply-Bonding Step

Three of the manufactured tissue paper webs were supplied to the embossing and gluing station illustrated in FIG. 1.

The first web (1) and the third web (3) were each advanced to the rubber rolls (8*a* and 8*b*) and embossed by the engraved rolls (9*a* and 9*b*). The second web (2) forming later the middle ply in the three-ply product was first advanced to the gluing unit (4) where the aforementioned aqueous adhesive composition was applied to one side of the web by the (level 2) protrusions (14) of the engraved roll (9*a*) which presses the web against glue applicator roll (7). The glue (aqueous adhesive composition) was applied only on the level 2 engraving (14) having about the double height of the level 1 engraving (13).

The gluing unit (4) includes the glue chamber (5), which contained the aqueous adhesive composition, an engraved anilox roll (6), which transferred the aqueous adhesive composition (at room temperature) from the glue chamber to the applicator roll (7), a rubber roll with even surface, which transferred the adhesive composition to the second web (2). A doctor blade (not shown in FIG. 1) metered the amount of glue on the anilox roll which is running at a differential speed to lower the amount of glue transferred to the applicator roll. The applicator roll is running at line speed. The anilox roll possesses at its surface small cells delivering a specific glue volume per $m^2$.

According to an embodiment, the volume of the anilox roll was adjusted to be 18 to 21 $cm^3/m^2$, the speed of the anilox roll was adjusted to be 10% of the line speed and the glue-bonded area, which corresponds to the total area of all bonded areas (12) as shown in FIG. 2, was 4 to 6% of the total surface of the tissue paper product.

The three paper tissue webs were superimposed, first web (1) and (2), then also web (3) in the nip between roll (9*a*) and (9*b*), where however no pressure was applied, and further advanced to the nip between engraved roll (9*a*) and marrying roll (10) where all three webs were bonded together by pressing the glue covered areas (12) together.

The bonded webs were then cut-to-size, perforated and further converted to toilet paper rolls.

As it can be seen from FIGS. 2 and 3, the resulting three-ply toilet paper displays three embossing patterns: the micro-embossing patterns (15*a*, 15*b*) (cf. level 1 engraving, 13) and the macro-embossing pattern (16) (cf. level 2 engraving, 14) which also serves as decorative pattern.

All embossing patterns of the prepared tissue paper product covered the entire surface of the tissue paper product.

The applied amount of said adhesive composition, in terms of all ingredients except water, was 0.39 wt.-%, based on the basis weight of the tissue paper product.

The pH value of the tissue paper product was 5.6 as determined by the ISO 6588-1:2012(E) method.

Comparative Example 1 and Examples 2 to 12

12 different three-ply tissue paper products (toilet paper) were produced in the same manner as set forth in Example 1 apart from the differences shown in table 1 and explained below:

In comparative example 1 and in examples 2 to 5 as well as examples 8 to 12 the same paper-making fibers and ply composition were used as in example 1.

In examples 6 and 7, the roll paper was composed of 3 plies comprising 26% recycled fibers and 74% virgin fibers. The ply composition was as follows:

- two outer plies made from 60% bleached *Eucalyptus* Kraft Pulp and 40% bleached Softwood Kraft pulp
- one inner ply made from 20% bleached *Eucalyptus* Kraft Pulp and 80% deinked pulp fibers In Comparative Example 1 (CEx 1), no acid was added to the aqueous adhesive composition.

In examples 6 and 7, raw tissue paper webs were prepared according to the conventional dry crepe process from a pulp mixture comprising 26% recycled fiber and 74% virgin fibers.

Zelura Glue used in example 12 is a methyl cellulose-based adhesive and commercially available as a solid from Henkel. 33.3 parts by wt. solid were dissolved in 966.7 parts by wt. water to produce about 11 of aqueous adhesive.

As seen from these results, all examples led to an effective change in pH. The adhesive power of the prepared aqueous composition was good despite the presence of greater amounts of acid/buffer.

TABLE 1

| | | Example | | | | | | |
|---|---|---|---|---|---|---|---|---|
| | | CEx 1 | 2 | 3 | 4 | 5 | 6 | 7 |
| Raw tissue paper | pH (ISO 6588-1) | 7.7 | 7.7 | 7.7 | 7.7 | 7.7 | 9.0 | 9.0 |
| Paper-making fibers | | Virgin | virgin | virgin | virgin | virgin | recycled + virgin | recycled + virgin |
| Raw tissue paper basis wt. | [g/$m^2$] | 56.8 | 56.8 | 56.8 | 56.8 | 56.8 | 49.3 | 49.3 |
| Gluing Surface | % | 4.4 | 4.4 | 4.4 | 4.4 | 4.0 | 4.0 | 8 |
| Anilox speed | % | 10 | 10 | 10 | 10 | 10 | 10 | 10 |
| Adhesive type/ | Swift ®tak 1004 [g] | 180 | 180 | 180 | 180 | 180 | 180 | 180 |
| solid content | Zelura Glue [g] | — | — | — | — | — | — | — |
| Water content | $H_2O$ [g] | 820 | 820 | 820 | 820 | 820 | 820 | 820 |
| Buffer | Lactic Acid [g] | — | 616 | 352 | 410.6 | 616 | 616 | 616 |
| | Citric Acid [g] | — | — | — | — | — | — | — |
| | KOH [g] | — | 23.2 | 10 | 11.6 | 23.2 | 23.2 | 23.2 |
| | $H_2O$ [g] | 2000 | 1717.3 | 1648 | 1922.6 | 1717.3 | 1717.3 | 1717.3 |
| | Molarity acid [M] | — | 2.366 | 1.604 | 1.604 | 2.366 | 2.366 | 2.366 |
| | pH | — | 2 | 2 | 2 | 2 | 2 | 2 |
| pH of adh. comp. | | 4.51 | 2.27 | 2.22 | 2.20 | 2.27 | 2.27 | 2.27 |
| Viscosity adh. Comp. | (mPa s) | 63 | 117 | 93 | 85 | 117 | 117 | 117 |
| Ratio (by wt.) | Adhesive/Buffer | 100:0 | 30:70 | 33:67 | 30:70 | 30:70 | 30:70 | 30:70 |
| Tissue paper product | pH (ISO 6588-1) | 7.2 | 5.3 | 5.9 | 5.9 | 5.1 | 6.0 | 5.9 |

| | | Example | | | | |
|---|---|---|---|---|---|---|
| | | 8 | 9 | 10 | 11 | 12 |
| Raw tissue paper | pH (ISO 6588-1) | 7.7 | 7.5 | 7.7 | 7.5 | 7.5 |
| Paper-making fibers | | virgin | virgin | virgin | virgin | virgin |
| Raw tissue paper basis wt. | [g/$m^2$] | 56.8 | 56.2 | 56.8 | 56.2 | 56.2 |

TABLE 1-continued

| | | | | | | |
|---|---|---|---|---|---|---|
| Gluing Surface | % | 8 | 8 | 4.4 | 8 | 8 |
| Anilox speed | % | 10 | 30 | 10 | 10 | 10 |
| Adhesive type/ | Swift ®tak 1004 [g] | 180 | 180 | 180 | 180 | — |
| solid content | Zelura Glue [g] | — | — | — | — | 33.3 |
| Water content | $H_2O$ [g] | 820 | 820 | 820 | 820 | 966.7 |
| Buffer | Lactic Acid [g] | 616 | 616 | 678.8 | — | 528 |
| | Citric Acid [g] | — | — | — | 452.8 | — |
| | KOH [g] | 23.2 | 23.2 | 25 | 40 | 20 |
| | $H_2O$ [g] | 1717.3 | 1717.3 | 1892.6 | 1861.1 | 1472 |
| | Molarity acid [M] | 2.366 | 2.366 | 2.366 | 1.010 | 2.366 |
| | pH | 2 | 2 | 2 | 2 | 2 |
| pH of adh. comp. | | 2.27 | 2.27 | 2.24 | 2.25 | 2.17 |
| Viscosity adh. Comp. | (mPa s) | 117 | 117 | 77 | 80 | 25 |
| Ratio (by wt.) | Adhesive/Buffer | 30:70 | 30:70 | 28:72 | 30:70 | 33:67 |
| Tissue paper product | pH (ISO 6588-1) | 5.0 | 4.3 | 5.8 | 5.0 | 6.0 |

Example 13

Using a five-person panel and the flat electrode method described before, the tissue paper product of example 7 was tested for its effect on the skin surface pH of the forearm. The results are listed in Table 2 below.

TABLE 2

| | Test person | | | | |
|---|---|---|---|---|---|
| | #1 | #2 | #3 | #4 | #5 |
| | Initial pH | | | | |
| | 5.20 | 5.83 | 5.55 | 5.55 | 5.79 |
| | Skin treatment with/resulting pH | | | | |
| Ex. 7 | 5.03 | 5.40 | 5.40 | 5.32 | 5.45 |

The above results show that the pH of healthy skin can be stabilized by means of a tissue paper in accordance with embodiments of the present invention, even if the raw tissue paper used therein has a fairly high pH (pH 9.0 as in the case of example 7).

The invention claimed is:

1. A multi-ply fibrous product comprising at least two fibrous plies selected from the group consisting of:

(a) a multi-ply nonwoven product comprising at least two nonwoven plies comprising cellulosic fibres, (b) a tissue paper product comprising at least two tissue paper plies, and (c) a hybrid thereof comprising at least one tissue paper ply and at least one nonwoven ply comprising cellulosic fibers, wherein said at least two plies are bonded to each other by an aqueous adhesive composition comprising an adhesive component and a dermatologically acceptable and water soluble acid selected from the group consisting of inorganic acids; hydroxylated, organic acids having 2 to 24 carbon atoms; polymeric organic acids; and combinations thereof, wherein said acid and optionally a salt thereof are provided in such an amount that the pH of the multi-ply fibrous product measured according to ISO 6588-1: 2012(E) is in the range of from 3.5 to 6.

2. The multi-ply fibrous product as set forth in claim 1, wherein the aqueous adhesive composition contains the acid and optionally the salt thereof in a molar amount of 0.1 to 10 mol/1.

3. The multi-ply fibrous product as set forth in claim 1, wherein the aqueous adhesive composition is present in an amount, based on the total weight of all ingredients except water, of 0.01 to 2 wt.-% with respect to the weight of the multi-ply fibrous product.

4. The multi-ply fibrous product as set forth in claim 1, wherein the adhesive component is selected from (a) natural polymers selected from the group consisting of proteins and protein-based compounds, gums and gum-like materials, polysaccharide-based materials, and glues derived from animal products, and (b) synthetic polymers selected from the group consisting of PEI (polyethyleneimine), PAE (polyamidoamin-epichlorhydrine) and PVAm (polyvinylamine), polyvinyl alcohol (PVA), polyvinyl acetate (PVAC), vinyl acetate-ethylene (VAE), polyvinylpyrrolidone (PVP), polyurethanes and styrene-butadiene, and water-soluble or dispersible cellulose-based compounds, and any combination thereof.

5. The multi-ply fibrous product as set forth in claim 1, wherein the aqueous adhesive composition contains the optionally present salt thereof and the salt thereof corresponds to the selected acid.

6. The multi-ply fibrous product as set forth in claim 1, wherein the aqueous adhesive composition comprises a dermatologically acceptable acid and a salt thereof and both are present in amounts providing together a pH buffering capacity.

7. The multi-ply fibrous product as set forth in claim 1, wherein the plies comprise paper-making fibers selected from the group consisting of (i) only non-recycled cellulosic fibers, (ii) only recycled cellulosic fibers, and (iii) a mixture of non-recycled cellulosic fibers and recycled cellulosic fibers in a weight ratio of 99/1 to 1/99.

8. The multi-ply fibrous product as set forth in claim 1, wherein the number of plies is 2 to 8.

9. The multi-ply fibrous product as set forth in claim 1, wherein the adhesive composition is applied in at least one regular or irregular pattern to at least a part of the surface of the fibrous plies, wherein said regular or irregular pattern(s) cover(s) at least the central area of the fibrous plies.

10. The multi-ply fibrous product as set forth in claim 1, wherein the multi-ply fibrous product, has two outer plies, wherein at least one outer ply is embossed, thereby forming protuberances wherein the aqueous adhesive composition is applied to the distal end of at least a part of the protuberances which are arranged such as to bond together the two outer plies.

11. The multi-ply fibrous product as set forth in claim 1, wherein said multi-ply fibrous product comprises at least three plies including an embossed upper outer ply, an embossed lower outer ply, and a central ply, each outer ply comprising patterns in relief including at least in part discrete protuberances, and a central ply, the distal areas of at least part of the protuberances of each outer ply facing the central ply, and at least one of the upper outer ply and lower outer ply having a pattern density of at least 10 protuberances/$cm^2$, the lower outer ply comprising a first pattern and a second pattern, the height of the first pattern being less than the height of the second pattern, wherein the central ply and the upper outer ply are joined in a nested mode, and by the applied adhesive composition, to said lower outer ply at a level of at least part of the tips of the second pattern of said lower outer ply, wherein the height of the protuberances of the second pattern is 50% to 200% greater than the height of the protuberances of the first pattern.

12. The multi-ply fibrous product as set forth in claim 1, wherein the percentage of the total surface of the multi-ply fibrous product which is bonded by the adhesive composition is 1 to 20%.

13. The multi-ply fibrous product as set forth in claim 1, wherein said multi-ply fibrous product is selected from the group consisting of a wipe, a sanitary product, a paper handkerchief, a household towel, a towel, a tissue for facial use, a napkin/serviette, bed linen and a garment, wherein the multi-ply fibrous product has 2 to 8 plies.

* * * * *